US009439527B2

(12) United States Patent
Kljajic

(10) Patent No.: US 9,439,527 B2
(45) Date of Patent: Sep. 13, 2016

(54) HANGER

(75) Inventor: Stephane Kljajic, North Bondi (AU)

(73) Assignee: Global Shopping Network Pty. Ltd., North Bondi (AU)

( * ) Notice: Subject to any disclaimer, the term of this patent is extended or adjusted under 35 U.S.C. 154(b) by 0 days.

(21) Appl. No.: 14/130,096

(22) PCT Filed: Jun. 29, 2012

(86) PCT No.: PCT/AU2012/000753
§ 371 (c)(1),
(2), (4) Date: Mar. 13, 2014

(87) PCT Pub. No.: WO2013/000018
PCT Pub. Date: Jan. 3, 2013

(65) Prior Publication Data

US 2014/0197294 A1 Jul. 17, 2014

Related U.S. Application Data

(60) Provisional application No. 61/503,246, filed on Jun. 30, 2011.

(51) Int. Cl.
*A47G 29/08* (2006.01)

(52) U.S. Cl.
CPC ..... *A47G 29/083* (2013.01); *A47G 29/08* (2013.01); *Y10S 248/914* (2013.01)

(58) Field of Classification Search
CPC . A47G 29/083; A47G 29/08; Y10S 248/914
USPC ..... 248/914; 223/120
See application file for complete search history.

(56) References Cited

U.S. PATENT DOCUMENTS

| | | | | |
|---|---|---|---|---|
| 2,064,133 | A * | 12/1936 | Von Schroeder Albrecht | 248/214 |
| 2,532,255 | A * | 11/1950 | Davis | 248/215 |
| 7,322,554 | B2 * | 1/2008 | Caroselli et al. | 248/304 |
| 7,389,966 | B1 * | 6/2008 | Hunter | 248/304 |
| 7,464,911 | B1 * | 12/2008 | Yen | 248/304 |
| 7,661,644 | B1 | 2/2010 | Yen | |
| 2003/0038220 | A1 * | 2/2003 | Catan | 248/304 |

(Continued)

FOREIGN PATENT DOCUMENTS

| | | | |
|---|---|---|---|
| AU | 2008100710 | 8/2008 | |
| DE | 10323954 A1 * | 12/2004 | A47G 25/08 |

(Continued)

*Primary Examiner* — Eret McNichols
(74) *Attorney, Agent, or Firm* — Morgan, Lewis & Bockius LLP

(57) ABSTRACT

A hanger for hanging an article from a supporting surface is described. The hanger comprises a base body which includes a vertical axis which, when the base body is disposed on the supporting surface, extends substantially perpendicular to the supporting surface; a catch configured to catch a portion of a handbag for hanging therefrom; an arm connected at one end to the base body and at the other end to the catch, the arm operatively connected to the base body so as to swing about the vertical axis between a stowed position wherein the catch is disposed adjacent a perimeter of the base, and a deployed position wherein the catch is spaced from the base so that it hangs downwardly from the base to support the handbag below the supporting surface.

23 Claims, 8 Drawing Sheets

(56) References Cited

U.S. PATENT DOCUMENTS

| | | | | |
|---|---|---|---|---|
| 2004/0108432 | A1* | 6/2004 | Weitzman | 248/339 |
| 2005/0161570 | A1* | 7/2005 | Bauerly | 248/317 |
| 2006/0108496 | A1* | 5/2006 | Miranda | 248/690 |
| 2006/0108497 | A1* | 5/2006 | Miranda | 248/690 |
| 2007/0170329 | A1* | 7/2007 | Li | 248/304 |
| 2008/0042032 | A1* | 2/2008 | Yap et al. | 248/304 |
| 2009/0108164 | A1* | 4/2009 | Washio et al. | 248/339 |

FOREIGN PATENT DOCUMENTS

| | | | | |
|---|---|---|---|---|
| FR | 2861264 | A1 * | 4/2005 | A47B 13/16 |
| FR | 2954069 | * | 6/2011 | |
| FR | 2960397 | A3 * | 12/2011 | |
| GB | 2253998 | A * | 9/1992 | A47B 97/00 |
| WO | 2008/021307 | | 2/2008 | |
| WO | WO 2010037941 | A1 * | 4/2010 | |

* cited by examiner

HANGER

FIELD OF THE INVENTION

The present invention relates generally to a hanger for hanging articles from a supporting surface such as for example a table top. In preferred embodiments the hanger is suitable for hanging a small or medium-sized handbag so that it is disposed, when hanging, under the table top.

BACKGROUND OF THE INVENTION

Handbags and other hand-held fashion accessories can be very expensive. Those who own and carry these items often desire to protect, care for and maintain their value by keeping them off the floor when visiting restaurants and cafes.

There are times when it is not convenient or desirable to use a cloak room for this purpose, and sometimes a cloak room is not available. That is, some people become anxious when far from their favourite accessories.

It is known to hang these items from a table edge but known hanger designs for this purpose have limitations associated therewith, including structural weaknesses. Manufacturers and resellers have a high rate of returns of known hangers, since they break under normal handbag loading conditions. Strong hangers are not particularly attractive and thus are not commercially desirable. Other mechanisms are not convenient to use and are not able to be stowed in a small, neat configuration because of various design inadequacies.

In some known designs the hangers do not take a convenient form when it is desired to stow the hanger into a carrying bag. Other designs include bulky or ineffective fastening devices to maintain the stowed form.

The present invention seeks to provide an improved hanger.

SUMMARY OF THE INVENTION

In accordance with one aspect of the present invention there is provided a hanger for hanging an article from a supporting surface, the hanger comprising:

a base body which includes a vertical axis which, when the base body is disposed on the supporting surface, extends substantially perpendicular to the supporting surface;

a catch configured to catch a portion of a handbag for hanging therefrom;

an arm connected at one end to the base body and at the other end to the catch, the arm operatively connected to the base body so as to swing about the vertical axis between a stowed position wherein the catch is disposed adjacent a perimeter of the base, and a deployed position wherein the catch is spaced from the base so that it hangs downwardly from the base to support the handbag below the supporting surface.

Preferably a proximal end of the arm is mounted to the base at an off-centre position so that at least a distal portion of the arm swings outwardly from the perimeter of the base about the vertical axis to move from the stowed position to the deployed position. It is to be understood that the further the off-centre disposition of the mounting, the further the potential outswing from the base in the deployed position. Preferably the arm is mounted to the base in a perimeter region of the base to maximise the outward extension distance of the arm.

Preferably the proximal end of the arm is mounted on a plate which itself is fastened to the base body.

Preferably the base body resembles a house or a shell without a floor, and the plate forms at least a portion of the floor, and the proximal end of the arm is disposed between the plate and the base.

A connecting chain is preferably disposed between the catch and the arm. Preferably the connecting chain includes a plurality of links. Preferably the connecting chain comprises three links. Preferably a first link is rigidly connected to the distal end of the arm so as to improve strength of a connection between the first link and the arm.

Preferably the arm is adapted to swing about the vertical axis and pivot about a second axis, the second axis preferably being parallel to the supporting surface when the base is disposed thereon.

Preferably the arm includes a ball or swivel disposed at the proximal end of the arm so that the arm may swing freely about the vertical axis and the horizontal axis when moving between the stowed position and the deployed position.

Preferably the base includes an aperture, the arrangement being such that the arm may be in use substantially disposed within the aperture at least when in the stowed position. The aperture may be a closed aperture. The aperture may include a bore and a track. The track is provided so that the arm may be guided along the perimeter of the base during its swing between the stowed and deployed positions. Preferably the track extends circumferentially around the perimeter of the base. The track also facilitates the chain and chain links remaining parallel to the base and/or supporting surface when in the stowed position. Preferably the bore is disposed at one end of the track, so that the track opens onto the bore. Preferably the bore extends radially into the base from the perimeter, and facilitates rotation about the second axis and facilitates detention of the arm in the deployed position, extending radially from the base. Preferably a portion of the arm includes cooperating side wall formations to cooperatively engage with the track. Preferably the cooperating side wall formations are lands or other suitable flat areas so as to inhibit pivoting of the arm about the second axis when in the stowed position and/or the track.

Preferably the track includes a pair of spaced-apart perimeter walls between which the arm is disposed when it is in the stowed position.

In one arrangement, where the catch is long enough to extend around the base so that in the stowed position it is adjacent the first link or arm, a fastener is provided to fasten the first link or arm to the catch. The fastener may be any suitable fastener. Preferably the fastener is a magnet or a magnet pair. Preferably a first magnet is disposed in a distal end of the catch. Preferably a second magnet is disposed in a proximal end of the first link or arm so that the second magnet fastens to the first magnet.

Preferably the base body is a cylinder. Preferably the cylinder includes a base wall which is circular or disc-shaped and a perimeter wall which extends from the circumference of the base wall to a corresponding circular or disc-shaped top wall.

Preferably the chain includes sufficient links to extend around the perimeter wall once so that the distal end of the last link abuts the proximal end of the first link. Preferably the links and the catch correspond in shape to the perimeter wall so that they form arcuate bodies and abut the perimeter wall and fit snugly against that wall when in the stowed position.

According to another form of the invention there is provided a hanger for hanging an article from a supporting surface, the hanger comprising:

a base body;

a catch configured to catch a portion of a handbag for hanging therefrom;

an arm operatively connected to the base body at one end and the catch, at the other end, the arm being adapted to move the catch between a stowed position in which the catch is disposed adjacent the base, and a deployed position in which the catch hangs downwardly from the base;

wherein the arm includes a first limb integral with or connected to a second limb, the first and second limbs being disposed substantially orthogonal to one another.

According to yet another aspect of the present invention there is provided a hanger for hanging an article from a supporting surface, the hanger comprising:

a base body;

a chain including a plurality of links pivotally connected to one another, the chain including a first link and another link, the other link including a catch for receiving a portion of a handbag for hanging therefrom, the chain being adapted to move between a stowed position wherein each of the plurality of links is disposed adjacent the base, and a deployed position wherein the plurality of links hang downwardly from the base to support the catch below the supporting surface;

wherein a fastener is provided to fasten the first link to the last link when the chain is in the stowed position.

DESCRIPTION OF THE DRAWINGS

In order to enable a clearer understanding, the invention will now be further explained and illustrated by reference to the accompanying drawings in which a preferred embodiment is shown and in which.

DETAILED DESCRIPTION OF A PREFERRED EMBODIMENT

Figure 1:
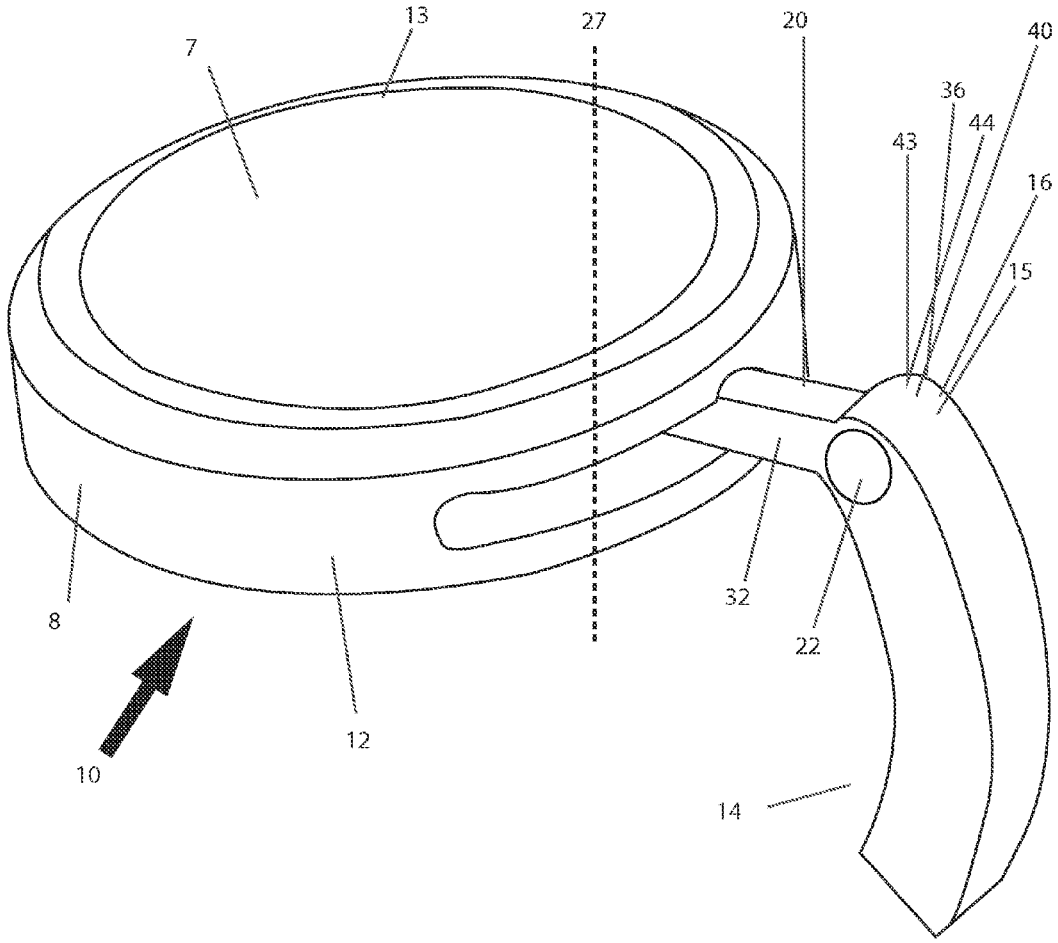
FIG. 1 is an isometric view of a hanger according to a preferred embodiment of the invention, the hanger in a deployed position wherein only a first chain link is shown for clarity.

Referring to the drawings there is shown a hanger for hanging an article from a supporting surface such as for example a table (not shown), the hanger generally indicated at 10. The hanger 10 comprises a base body 12, a chain 14 including a plurality of chain links 16 pivotally connected to one another, the chain 14 including a first link 15 and a last link 17, the last link 17 including a catch 18 for receiving a portion of a handbag (not shown) for hanging therefrom, such as for example a handbag strap (not shown).

The base body 12 is a cylinder 13. Preferably the cylinder includes a base wall 9 which is circular or disc-shaped and a perimeter wall 8 which extends from the circumference of the base wall to a corresponding circular or disc-shaped top wall 7. The base body 12 includes a vertical axis 27 which in use extends perpendicular to the supporting surface (not shown). The base body 12 also includes a second axis 26 which extends parallel to the supporting surface (not shown).

Preferably the chain 14 includes sufficient chain links 16 to extend around the perimeter wall 8 once when the chain is in the stowed position so that a distal end of the last link 17 abuts the proximal end of the first link 15. The chain in preferred embodiments includes four chain links 15, 5, 6 and 17. The chain links correspond substantially in shape to the perimeter wall 8 so that they abut the perimeter wall 8 and fit snugly against that wall when in the stowed position.

Figure 2:
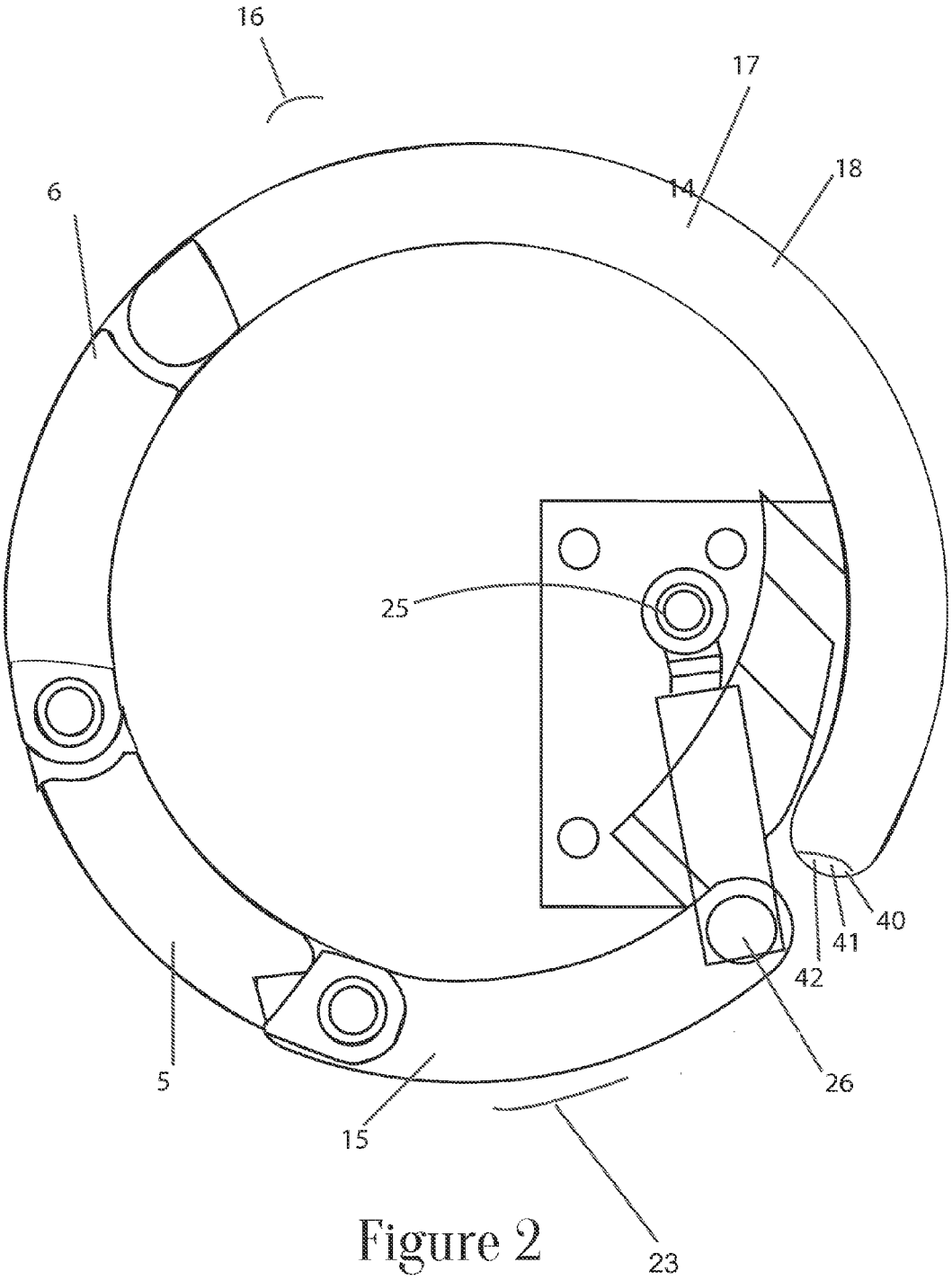
FIG. 2 is a plan view of the hanger of FIG. 1 in a stowed position with all chain links shown, and some hidden details also shown.
Figure 3:
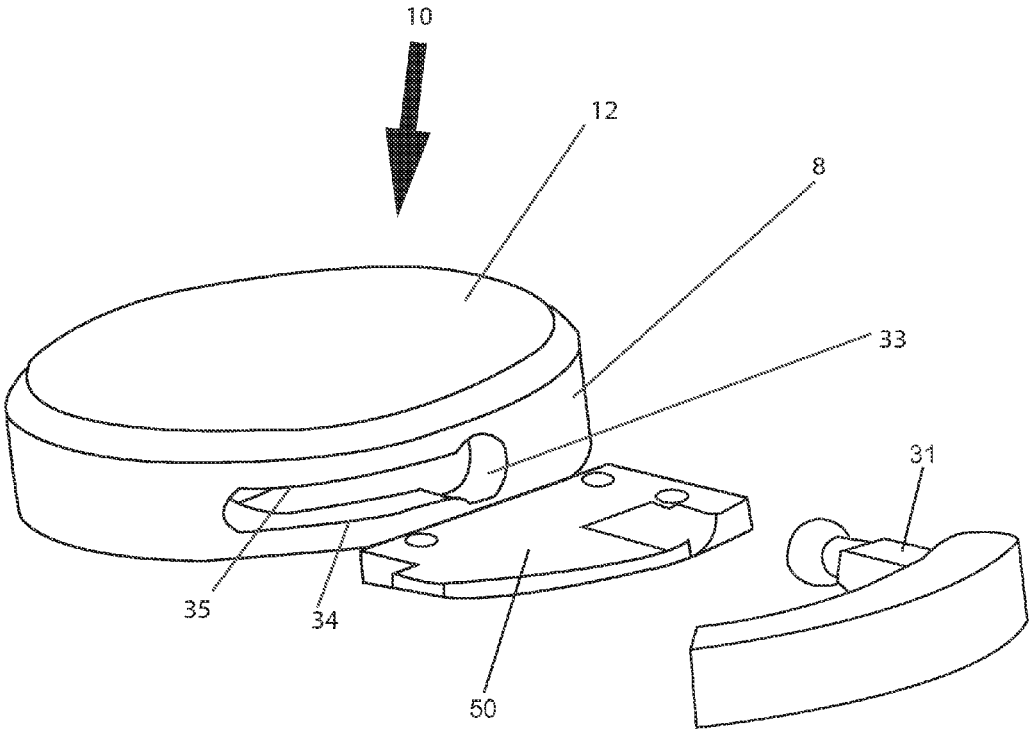
FIG. 3 is an exploded view of the hanger of FIG. 1 with some chain links removed for clarity.
Figure 4:
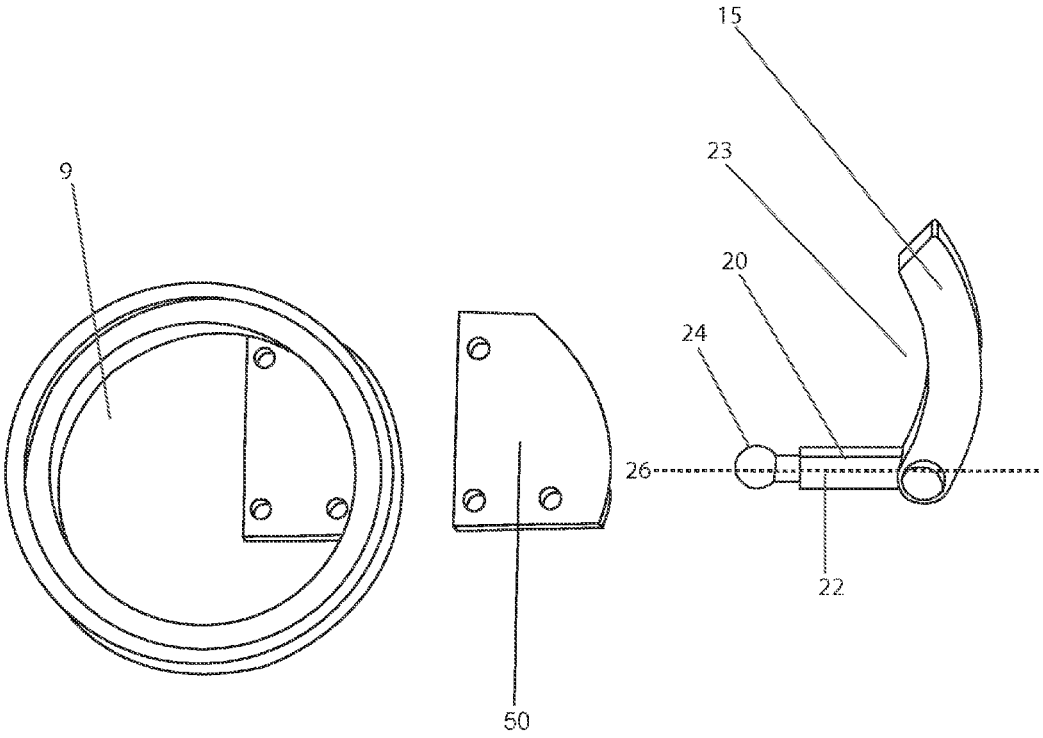
FIG. 4 is an exploded view from underneath of the hanger of FIG. 1 with some chain links removed for clarity.
Figure 5:
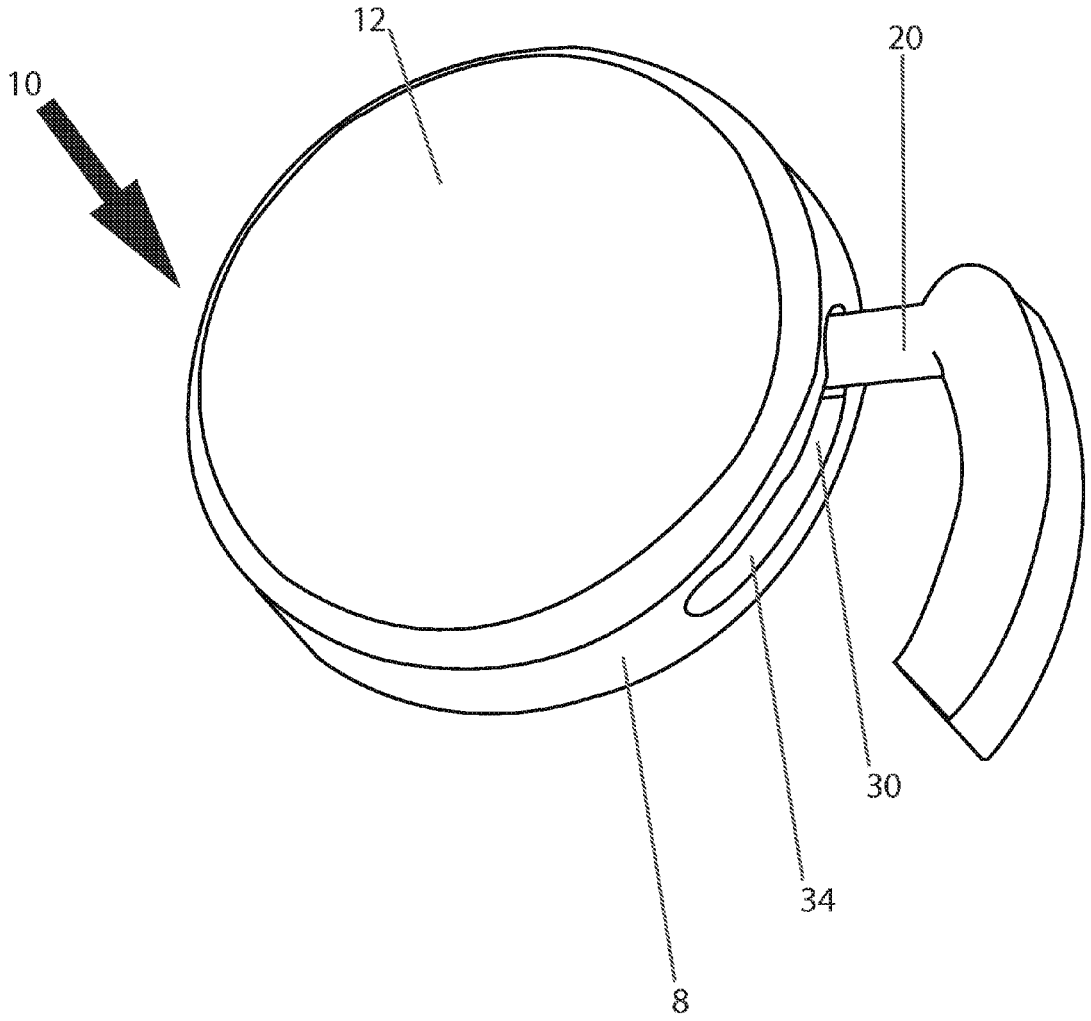
FIG. 5 is an isometric view of the hanger of FIG. 1 with some chain links removed for clarity.
Figure 6:
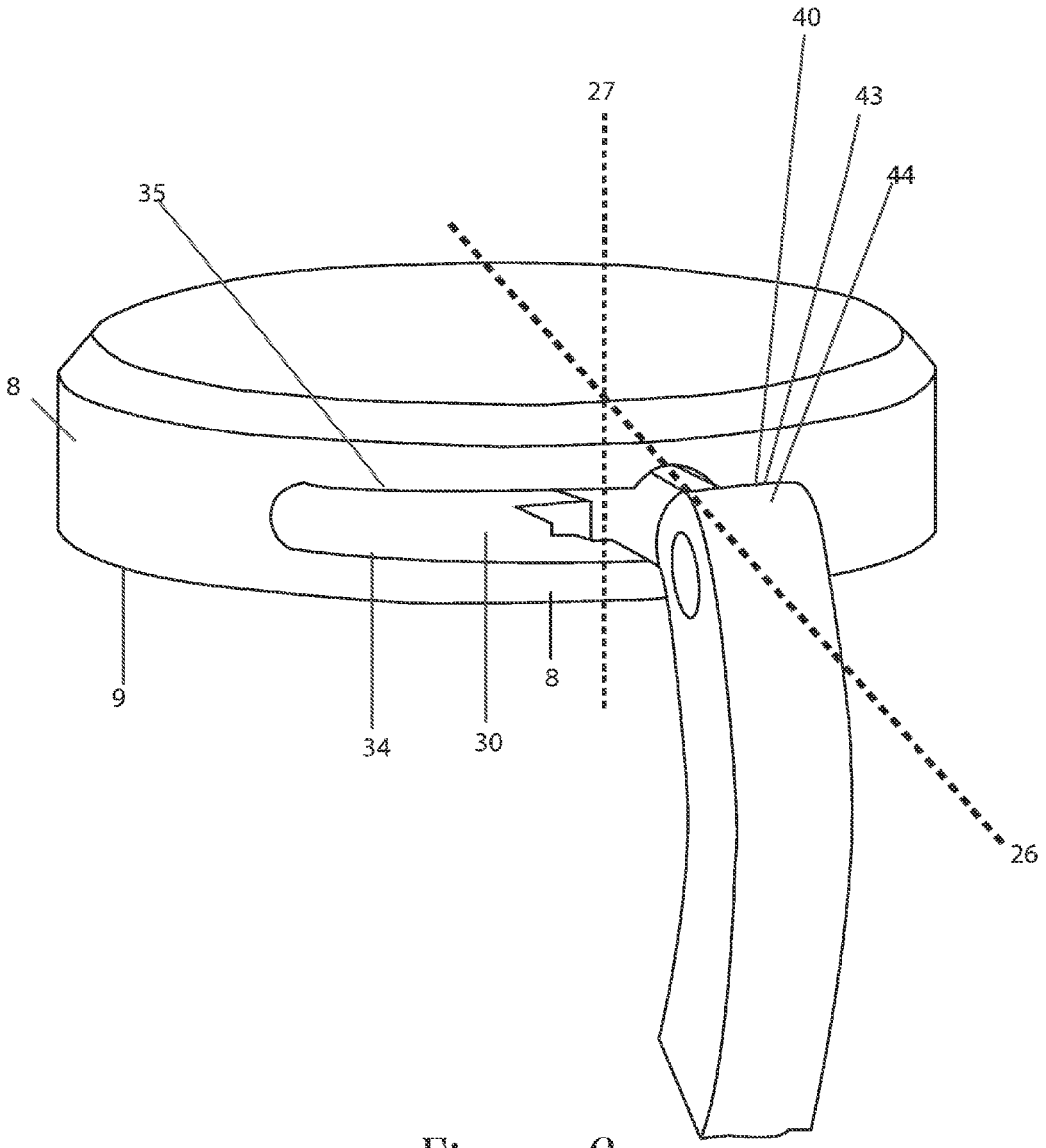
FIG. 6 is an isometric view of the hanger of FIG. 1 in a deployed position with some chain links removed for clarity.
Figure 7:
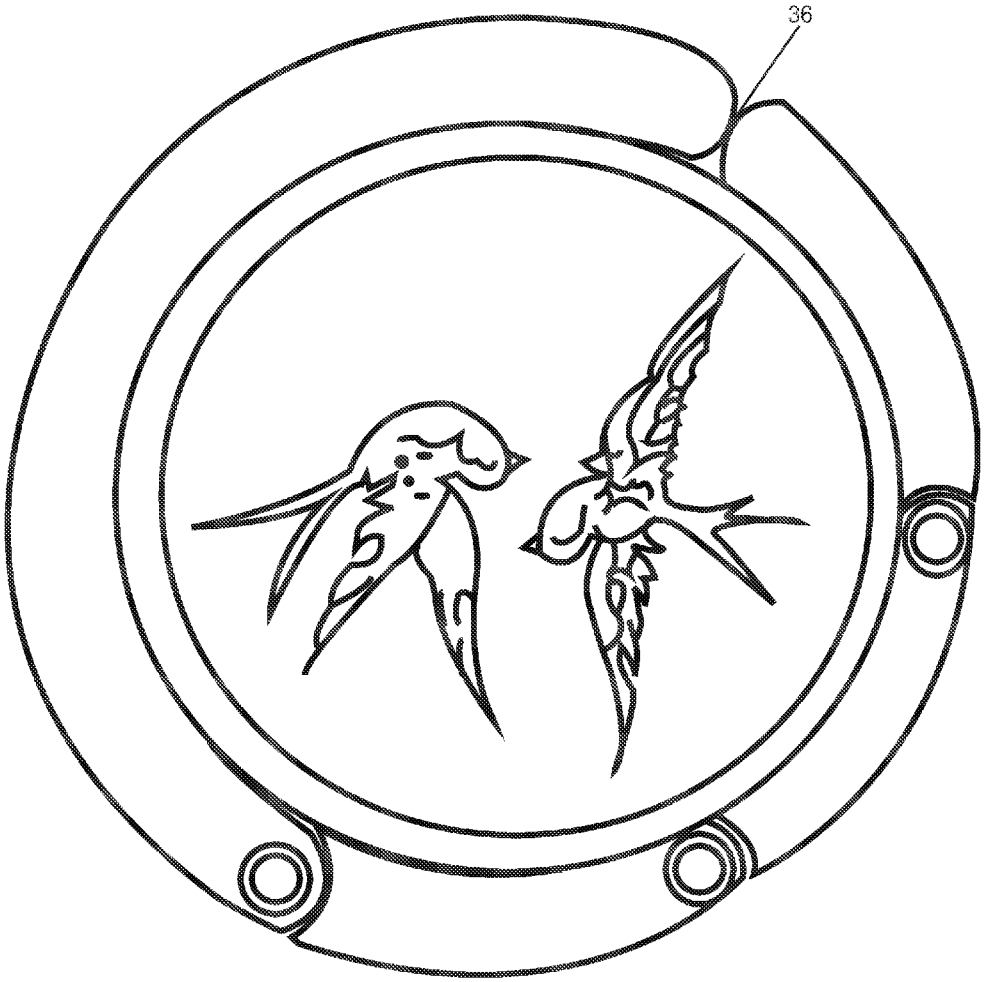
FIG. 7 is a plan view of the hanger of FIG. 1 with all chain links showing, the hanger in the stowed position.
Figure 8:
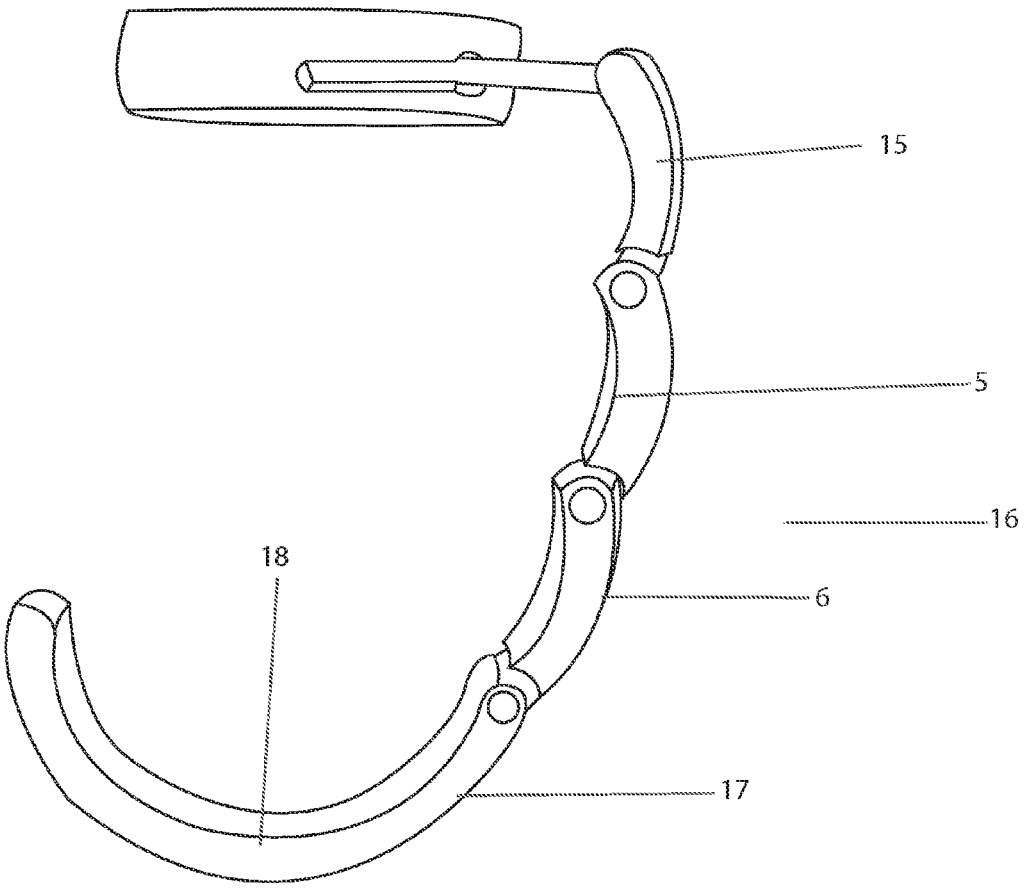
FIG. 8 is a perspective view of the hanger of FIG. 1 from underneath a supporting surface, the hanger being shown in the deployed position.

An arm 20 is provided and is operatively connected to the base body 12, the arm being adapted to move the first link 15 and the remainder of the chain 14 including the catch 18 between a stowed position (FIG. 2) in which the chain links 16 are disposed adjacent a perimeter wall 8 of the base body 12, and a deployed position (FIG. 6) in which the chain links 16 hang downwardly from the base body 12 to support the catch 18 below the supporting surface or table (not shown).

The arm 20 in the preferred embodiment shown is affixed to or integral with the first link at a distal end 22 such that the arm 20 and first link 15 are rigidly connected and move as one link body 23. At its other, proximal end, 24, the arm 20 is operatively connected to an interior region 25 of the base body 12. The arm 20 is pivotally connected to the interior region 25 at an off-centre position adjacent the perimeter of the base so that the arm 20 swings between the stowed and deployed positions and the distal end 22 of the arm 20, when in the deployed position, extends from the perimeter wall 8 and is spaced therefrom a selected distance.

The arm 20 is adapted to swing about the vertical axis 27 and pivot about the horizontal axis 26.

To facilitate this swing and pivot motion, the arm 20 includes a ball connection 28 to the base body 12 such that the arm 20 may swing about the vertical axis 27 and pivot about the horizontal 26 at selected times. The base body 12 includes a track 30 and the arrangement of the arm 20 is such that the arm 20 is substantially within the track 30 at least when in the stowed position so that the arm 20 may be guided by the track between the stowed and deployed positions. The track 30 includes spaced-apart walls of the base body 12 and extends along the perimeter between spaced-apart perimeter walls 34, 35. The track also facilitates the chain 14 and chain links 16 remaining parallel to the base body 12 and/or supporting surface (not shown) when in the stowed position.

The base body 12 includes a plate 50 which includes a socket to receive the ball 28 and allows the arm 20 to pivot about axes 26 and 27. The base body 12 is in the form of a hollow housing without a floor, and the plate 50 forms at least a portion of the floor. The proximal part of the arm is disposed between the plate 50 and the roof of the housing.

The arm 20 further includes cooperating side wall formations 31 to cooperate with the track 30. The cooperating side wall formations are in the form of lands 32 or other suitable flat areas so as to inhibit rotation of the arm 20 about its longitudinal axis 26 when in the stowed position and in the track 30 so that the chain and catch remain generally parallel to the perimeter wall 8 of the base body when the arm 20 is in the track 30 (that is, until the arm is fully in the deployed position, that is, disposed in a bore 33.

That is, the base body 12 includes a bore 33 for receiving the arm 20 when in the deployed position, the bore 33 facilitating rotation about the second axis 26, being the longitudinal axis of the arm 20. The bore 33 extends radially from a base perimeter wall to an interior region of the base and is disposed at one end of the track 30.

A fastener 36 is provided to fasten the first link 15 to the last link 17. The fastener may be any suitable fastener, such as for example an interlocking ball and socket mounted on the links or between the links and the base body, but in preferred forms of the invention the fastener is a magnet 40 or a magnet pair. In the preferred arrangement, the first magnet 41 is disposed in a distal end 42 of the last link 17. A second magnet 43, being disposed in a proximal end 44 of the first link 15, is arranged so that the second magnet 43 fastens to the first magnet 41 when the chain is in the stowed position.

In operation it can be seen that the hanger 10 moves from the stowed position (FIG. 2) to the deployed position (FIG. 1) by swinging the arm 20 along the track 30. During the swing, the arm begins to progressively extend outward so that the distal end of the arm is spaced from the perimeter wall 8 of the base body 12. Also during the swing, while the arm is in the track 30, the cooperating flat walls of the arm 20 maintain the chain links and catch generally parallel to the base body 12. Once the arm extends fully to the deployed position the arm is freed from the track and is disposed in the bore so that it can then rotate about its own longitudinal (horizontal) axis 26. The ball and socket joint facilitates this rotation. The chain then unfurls and the catch is ready to catch a handbag for hanging under the supporting surface.

The word 'comprising' and forms of the word 'comprising' as used in this description do not limit the invention claimed to exclude any variants or additions.

Modifications and improvements to the invention will be readily apparent to those skilled in the art. Such modifications and improvements are intended to be within the scope of this invention.

In this specification, where a document, act or item of knowledge is referred to or discussed, this reference or discussion is not an admission that the document, act or item of knowledge or any combination thereof was at the priority date:

part of common general knowledge; or known to be relevant to an attempt to solve any problem with which this specification is concerned.

The invention claimed is:

1. A hanger for hanging an article from a supporting surface, the hanger comprising:

a base body which includes a vertical axis which, when the base body is disposed on the supporting surface, extends substantially perpendicular to the supporting surface;

a catch configured to catch a portion of a handbag for hanging therefrom;

an arm connected at one end to the base body and at the other end to a connecting chain disposed between the catch and the arm, the arm operatively connected to the base body so that a longitudinal axis of the arm swings about the vertical axis between a stowed position wherein the catch is disposed adjacent a perimeter of the base, and a deployed position wherein the catch is spaced from the base so that it hangs downwardly from the base to support the handbag below the supporting surface.

2. A hanger in accordance with claim 1 wherein a proximal end of the arm is mounted to the base at an off-centre position relative to a centre of the base body so that at least a distal portion of the arm swings outwardly from the perimeter of the base about the vertical axis to move from the stowed position to the deployed position.

3. A hanger in accordance with claim 2 wherein the proximal end of the arm is mounted on a plate which itself is fastened to the base body.

4. A hanger in accordance with claim 2 wherein a first link is rigidly connected to the distal end of the arm so as to improve strength of a connection between the first link and the arm.

5. A hanger in accordance with claim 1 wherein the arm is mounted to the base in a perimeter region of the base to maximize the outward extension distance of the arm.

6. A hanger in accordance with claim 1 wherein the connecting chain includes a plurality of links.

7. A hanger in accordance with claim 1 wherein the arm is adapted to pivot about a horizontal axis, the horizontal axis being parallel to the supporting surface when the base is disposed thereon.

8. A hanger in accordance with claim 7 wherein the arm includes a ball and socket joint disposed at a proximal end of the arm so that the arm may swing freely about the vertical axis and the horizontal axis when moving between the stowed position and the deployed position.

9. A hanger in accordance with claim 7 wherein the base includes an aperture, the arrangement being such that the arm may be in use substantially disposed within the aperture at least when in the stowed position.

10. A hanger in accordance with claim 9 wherein the aperture includes a bore and a track.

11. A hanger in accordance with claim 10 wherein the track is provided so that the longitudinal axis of the arm may be guided along the perimeter of the base during its swing between the stowed and deployed positions.

12. A hanger in accordance with claim 10 wherein the track extends circumferentially around the perimeter of the base.

13. A hanger in accordance with claim 10 wherein the bore is disposed at one end of the track, so that the track opens onto the bore.

14. A hanger in accordance with claim 10 wherein the bore extends radially into the base from the perimeter, and facilitates rotation about the horizontal axis and facilitates detention of the arm in the deployed position in which it extends radially from the base.

15. A hanger in accordance with claim 10 wherein a portion of the arm includes cooperating side wall formations to cooperatively engage with the track, to inhibit pivoting of the arm about the horizontal axis when in at least one of the stowed position and the track.

16. A hanger in accordance with claim 10 wherein the track includes a pair of spaced-apart perimeter walls between which the arm is disposed when it is in the stowed position.

17. A hanger in accordance with claim 1 wherein a fastener is provided to fasten the first link or arm to the catch.

18. A hanger in accordance with claim 17 wherein the fastener is a magnet or a magnet pair.

19. A hanger in accordance with claim 17 wherein a first magnet is disposed in a distal end of the catch.

20. A hanger in accordance with claim 17 wherein a second magnet is disposed in a proximal end of the first link or arm so that the second magnet fastens to the first magnet.

21. A hanger for hanging an article from a supporting surface, the hanger comprising:

a base body which includes a vertical axis which, when the base body is disposed on the supporting surface, extends substantially perpendicular to the supporting surface;

a catch configured to catch a portion of a handbag for hanging therefrom;

an arm comprising a ball and socket joint disposed at a proximal end of the arm so that the arm may swing freely about the vertical axis and a horizontal axis when moving between a stowed position and a deployed position, wherein the arm is connected at one end to the base body and at the other end to a connecting chain disposed between the catch and the arm, the arm operatively connected to the base body so that a longitudinal axis of the arm swings about the vertical axis between the stowed position wherein the catch is disposed adjacent a perimeter of the base, and the deployed position wherein the catch is spaced from the base so that it hangs downwardly from the base to support the handbag below the supporting surface.

22. A hanger for hanging an article from a supporting surface, the hanger comprising:

a base body comprising an aperture and a vertical axis which, when the base body is disposed on the supporting surface, extends substantially perpendicular to the supporting surface;

a catch configured to catch a portion of a handbag for hanging therefrom;

wherein an arm is connected at one end to the base body and at the other end to a connecting chain disposed between the catch and the arm, the arm operatively connected to the base body so that a longitudinal axis of the arm swings about the vertical axis between a stowed position wherein the catch is disposed adjacent a perimeter of the base, and a deployed position wherein the catch is spaced from the base so that it hangs downwardly from the base to support the handbag below the supporting surface, the aperture comprises a bore and a track, the arrangement of which being such that the arm may be in use substantially disposed within the aperture at least when in the stowed position, and the track is provided so that the longitudinal axis of the arm may be guided along the perimeter of the base during its swing between the stowed and deployed positions.

23. A hanger in accordance with claim 22 wherein the track extends circumferentially around the perimeter of the base.

* * * * *